US008419301B2

(12) United States Patent
Kubota

(10) Patent No.: US 8,419,301 B2
(45) **Date of Patent: *Apr. 16, 2013**

(54) PRINTER, PRINTER FEED DRIVE METHOD, AND COMPUTER PROGRAM THEREFOR

(75) Inventor: Tomoyuki Kubota, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 13/476,833

(22) Filed: May 21, 2012

(65) Prior Publication Data

US 2012/0281053 A1 Nov. 8, 2012

Related U.S. Application Data

(62) Division of application No. 12/336,034, filed on Dec. 16, 2008, now Pat. No. 8,202,013.

(30) Foreign Application Priority Data

Dec. 19, 2007 (JP) ..... 2007-327166

(51) Int. Cl.
*B41J 11/44* (2006.01)
*B41J 11/00* (2006.01)

(52) U.S. Cl.
USPC ..... 400/76; 400/615.2; 400/621

(58) Field of Classification Search ..... 400/76, 400/88, 613, 615.2, 621
See application file for complete search history.

(56) References Cited

U.S. PATENT DOCUMENTS

| | | | | |
|---|---|---|---|---|
| 5,152,621 | A | 10/1992 | Tsuji | 400/208 |
| 5,222,818 | A | 6/1993 | Akiyama et al. | 400/61 |
| 6,270,269 | B1 | 8/2001 | Watanabe et al. | 400/615.2 |
| 6,394,675 | B1 | 5/2002 | Sodeyama et al. | 400/615.2 |

FOREIGN PATENT DOCUMENTS

| | | |
|---|---|---|
| JP | 2003-237155 | 8/2003 |

*Primary Examiner* — Judy Nguyen
*Assistant Examiner* — Blake A Tankersley
(74) *Attorney, Agent, or Firm* — DLA Piper LLP (US)

(57) ABSTRACT

Provided herein is a printer, including a printing head configured to execute printing in units of columns of dots; a feed roller configured to feed a print medium; a motor configured to drive the feed roller; a drive control section configured to control driving of the printing head and the motor, wherein in case of halting and restarting printing operation, the drive control section implements printing of data for a first dot column to be printed at printing restart after driving the motor by a first driving amount, further restarts printing from the first dot column data after driving the motor by a second driving amount.

8 Claims, 14 Drawing Sheets

FIG. 12A

ESTIMATED VALUE

| | |
|---|---|
| ENCODER VANES PER DOT | 4 OUT OF 8 VANES |
| MOTER STOPPING INERTIA AMOUNT | N PULSES (N<4) |
| MECHANICAL LOSS AMOUNT | 8±4 PULSES |

FIG. 12B

PREDICTED IDLING AMOUNT

= MOTOR STOPPING INERTIA AMOUNT + MECHANICAL LOSS AMOUNT

= (4-N)+(8±4)

(MAXIMUM VALUE: (16-N) PULSES
CENTER VALUE: (12-N) PLUSES
MINIMUM VALUE: (8-N) PLUSES)

WITH IDLING AMOUNT 3 DOTS (CENTER VALUE)

WITH IDLING AMOUNT 2 DOTS (MINIMUN VALUE)

WITH IDLING AMOUNT 4 DOTS (MAXIMUN VALUE)

<RELATED ART CASES>

WITH IDLING AMOUNT 3 DOTS (CENTER VALUE)

WITH IDLING AMOUNT 2 DOTS (MINIMUN VALUE)

WITH IDLING AMOUNT 4 DOTS (MAXIMUN VALUE)

PRINTER, PRINTER FEED DRIVE METHOD, AND COMPUTER PROGRAM THEREFOR

This application is a divisional of U.S. application Ser. No. 12/336,034, filed on Dec. 16, 2008, and claims the benefit of priority under 35 USC 119 of Japanese Patent Application No. 2007-327166, filed Dec. 19, 2007, which are incorporated by reference herein.

BACKGROUND

1. Technical Field

The present invention relates to a printer and a printer feed drive method in which feeding of the print tape or other print medium is driven in synchrony with driving of the printing head, and a computer program therefor.

2. Related Art

Printers of this type, which include a printing head that executes printing in units of columns of dots, a feed roller that feeds the print tape (print medium) in synchrony with driving of the printing head, and a motor that constitutes the drive source for the feed roller, have long been generally known (see, for example, JP-A-2003-237155). With printers of this type, if the drive start timing for the printing head is made identical with the drive start timing for the motor when printing operation is halted and restarted (in cases where the user performs control manipulations to stop printing, or cutting operation is performed in mid-printing, etc.), the motor idles at restart of printing operation (the state is such that feeding of the print medium does not start, despite the motor drive having started), with the result that the dot column printed before printing stop and the dot column printed after printing restart are superposed and printing blur occurs. Because of this, processing is required that keeps the printing drive stopped while the motor is idling (processing that delays the drive start timing for the printing head relative to that for the motor, which is termed "idling wait processing" below).

However, the duration for which the motor idles (termed the "idling amount" below) varies with the mode of cutting operation, nonuniformity of parts, and other factors. FIGS. 14A to 14C show printing results D in the case where the predicted value for the idling amount is 3 dots (the center value of the results of measurements made in tests) and there is a ±1 dot variation in the idling amount actually required. In FIGS. 14A to 14C, the leftward direction is the print tape feed direction, the top-and-bottom direction represents the widthwise direction of the print tape, and the lines in the columnar direction indicate the width of the dot columns. Also, the numerals and row-direction lines appearing in the figure indicate the arrangement of the heat-emitting elements (first to eighth elements), the case represented being that where a diagonal line (D1 to D8) is formed by printing dots one by one in accordance with the element numbers, using a procedure whereby the first element (D1) is made to emit heat for printing of the first dot column, the second element (D2) is made to emit heat for printing of the following dot column, and so on. Also, the four dots D1 to D4 corresponding to the first to fourth dots are printed before the printing is stopped, and the four dots D5 to D6 corresponding to the fifth to eighth dots are printed after the printing is restarted.

As FIG. 14A shows, in the case where the idling amount actually required is three dots (corresponding to the predicted value) an ideal printing outcome with the eight dots D1 to D8 arranged in a straight line is obtained when idling wait processing for three dots is implemented. On the other hand, as FIG. 14B shows, when the idling amount actually required is two dots (corresponding to the smallest measured value) a gap occurs between the fourth dot (D4) and fifth dot (D5) dot columns when idling wait processing for three dots is implemented. This is because the feeding operation is executed ahead of the operation of the printing head. Also, as FIG. 14C shows, when the idling amount actually required is four dots (corresponding to the largest measured value) the fourth dot (D4) and fifth dot (D5) are printed in the same column, blurring the printing, when idling wait for three dots processing is implemented. This is because the printing head's operation is executed one dot in advance.

Thus, when idling wait processing is implemented based on the predicted value for the idling amount, and the idling amount actually required is smaller than the predicted value (the case in FIG. 14B), or conversely, larger (the case in FIG. 14C), the printing quality will be impaired due to printing gaps, printing blur, or other irregularities. In order to enhance attractiveness, it is particularly desirable to lessen the occurrence of printing gaps, since gaps between dot columns are more conspicuous than printing blurs, even if occurring in the same amounts.

SUMMARY

An advantage of some aspects of the invention is to provide a printer and a printer feed drive method in which, when printing is halted and restarted, the occurrence of a gap between the dot column printed before printing stop and that printed after printing restart is suppressed; together with a computer program for such.

According to one aspect of the invention, a printer includes a printing head that executes printing in units of columns of dots, a feed roller that feeds a print medium in synchrony with driving of the printing head, a motor that constitutes the drive source for the feed roller, a memory section that memorizes the predicted idling amount, which is the amount of idling predicted to occur when drive of the motor starts, and a drive control section that controls driving of the printing head and the motor, in which, when printing operation is halted and restarted, the drive control section drives the motor by a first idling amount that is smaller than the predicted idling amount to implement printing based on data for the first dot column to be printed at printing restart, and restarts printing from the first dot column data after driving the motor by a subtraction amount that equals the predicted idling amount minus the first idling amount.

According to another aspect of the invention, a feed drive method is for a printer having a printing head that performs printing in units of columns of dots, a feed roller that feeds the print medium in synchrony with driving of the printing head, and a motor that constitutes the drive source for the feed roller; and includes: a step whereby printing operation is halted; a step whereby he printing head executes printing based on data for the first dot column to be printed at printing restart after the motor is driven by a first idling amount that is smaller than the predicted idling amount, which is the amount of idling of the motor that is predicted to occur when drive of the motor starts; and a step whereby the printing head restarts printing from the first dot column data after the motor is driven by a subtraction amount that equals the predicted idling amount minus the first idling amount.

With these configurations, the occurrence of a gap between the dot columns (between the dot column printed before printing stop and the dot column printed after printing restart) when printing operation is halted and restarted can be suppressed, because the motor is driven by a first idling amount that is smaller than the predicted idling amount (amount of idling predicted to occur when the motor drive starts) and then printing is implemented based on data for the first dot column to be printed at printing restart (hereinafter referred to as "dummy printing"). More precisely, if drive of the printing head is stopped just for the predicted idling amount, and the idling amount actually required is smaller than the predicted idling amount, feed operation will be executed ahead of the operation of the printing head and consequently a gap will occur between the dot columns. However, with this configuration such gap is filled in by the dummy printing, so that occurrence of printing gaps can be rendered inconspicuous. Also, since the dummy printing is based on the data for the first dot column to be printed at printing restart, the dummy-printed dot column will be harmonized with the dot column printed before printing stop and the dot column printed after printing restart, and so there will be no impairment of the print quality by the dummy printing.

Further, the term "the amount of idling predicted to occur when the motor drive starts" refers to the period of time that is predicted to be required from when the motor starts its drive up until feeding of the print medium is started. Also, "printing operation" refers to operation of the printing head and operation of the feed roller, which is synchronized with that of the printing head.

It is preferable that the memory section of the printer memorize as the predicted idling amount the center value or the mean value of the results of measurements of the idling amount made in tests, and that the first idling amount correspond to the smallest value among the measurement results.

The problem of a printing gap arises when the idling amount actually required is smaller than the predicted idling amount; the larger the difference between these two, the larger the gap will be. With this configuration, the dummy printing is executed based on the smallest value among the measurement results, so that the printing gap can be effectively rendered inconspicuous with a single dummy printing.

It is preferable that the printer further includes a printing data generating section that generates printing data, and a cutter that cuts the print medium so that a printed portion has s lengths based on the printing data in accordance with the drive control section; and that, in the case where the portion that has been printed is such that LA, which is the leading margin dimension, equivalent to the distance from the leading edge of the print medium to the printing start position, is less than LH, which is the distance between the printing head and the cutter, the drive control section halt printing operation at the moment when a portion equivalent to LH minus LA has been printed, and restart printing operation after the cutter has cut the print medium.

With this configuration, printing outcomes as the user desired (in accordance with the printing data) can be obtained, because in cases where the printing data are such that the leading margin dimension LA is less than the distance LH between the printing head and cutter, the print medium is cut at the moment when a portion equivalent to LH minus LA has been printed. More precisely, if such cutting processing is not carried out, it will not be possible to obtain printing outcomes other than a case in which $LA \geqq LH$ unless the print medium is fed backward, in the opposite direction to the printing direction, whereas carrying out such cutting processing enables printing outcomes such that $LA < LH$ to be obtained without implementing backfeed of the print medium. However, when such cutting processing is carried out, variation in the motor idling amount may become larger, so that occurrence of printing gaps becomes a problem. Hence, combining this configuration with the aspect of the invention that implements dummy printing can be expected to produce greater beneficial effects.

It is preferable that the printer further includes a roller reduction gear train that transmits power of the motor to the feed roller, a cutter reduction gear train that transmits the power of the motor to the cutter, and a clutch that transmits regular rotational power of the motor to either the feed roller reduction gear train or the cutter reduction gear train, and transmits reverse rotational power of the motor to the other of the two.

With this configuration, a single motor can be used for both feed operation and cutting operation, thus reducing the number of parts and the time and labor for assembly. However, because a clutch is used, variation in the clutch switchover angle, and the timing for clutch switchover (meshing of the gears), may result in larger variation in the motor idling amount, so that occurrence of printing gaps may become a problem. Hence, combining this configuration with the aspect of the invention that implements dummy printing can be expected to produce greater beneficial effects.

It is preferable that the printer further includes a reverse rotation inhibiting mechanism that is installed on the input side of the roller reduction gear train and inhibits reverse rotation of the feed roller; and that the reverse rotation inhibiting mechanism be actuated when reverse rotational power of the feed roller is back-input into the roller reduction gear train, whereupon the reverse rotation inhibiting mechanism inhibits reverse rotation of a single gear disposed on the input side of the roller reduction gear train.

With this configuration, because the reverse rotation inhibiting mechanism is installed on the input side of the roller reduction gear train, when the feed roller rotates in reverse, the reverse rotational power therefrom is stepped up and transmitted to the reverse rotation inhibiting mechanism, actuating the latter. (If, for example, the reverse rotation inhibiting mechanism is actuated by a 5° rotation of the object to which it is coupled, and the degree of reduction from the feed roller up to the aforementioned gear is $1/50$, then it will be possible to stop the reverse rotation only by $5 \times 1/50 = 0.1°$ rotation of the feed roller) Thereby, following performance is improved and the amount of reverse rotation when the feed roller rotates in reverse is lessened. As a result, backfeeding of the print medium is suppressed, and print processing onto the print medium can be executed with good precision. However, providing a reverse rotation inhibiting mechanism may, due to variation in the operating angle of the reverse rotation inhibiting mechanism, result in larger variation in the motor idling amount, so that occurrence of printing gaps may become a problem. Hence, combining this configuration with the aspect of the invention that implements dummy printing can be expected to produce greater beneficial effects.

According to a further aspect of the invention, a computer program is for enabling a computer to execute each step in the foregoing printer feed drive method.

By using this computer program, a printer feed drive method can be realized that is able to suppress the occurrence of gaps between the dot columns when printing is halted and then restarted.

BRIEF DESCRIPTION OF THE DRAWINGS

The invention will be described with reference to the accompanying drawings, wherein like numbers reference like elements.

FIGS. 12A and 12B set forth an estimated value and a calculation formula for deriving the predicted idling amount.

DESCRIPTION OF EXEMPLARY EMBODIMENT

A printer according to an embodiment of the invention will be described with reference to the accompanying drawings. The example described here is that of a tape printer that uses print tape as the printing medium. Such tape printer (the printer) carries out printing onto the print tape as desired by means of keyed input, and also has the ability to cut off the portions of the print tape that have been printed. The cut-off pieces of tape can be used as labels that are stuck onto, for example, document files, or cabling.

Figure 1:
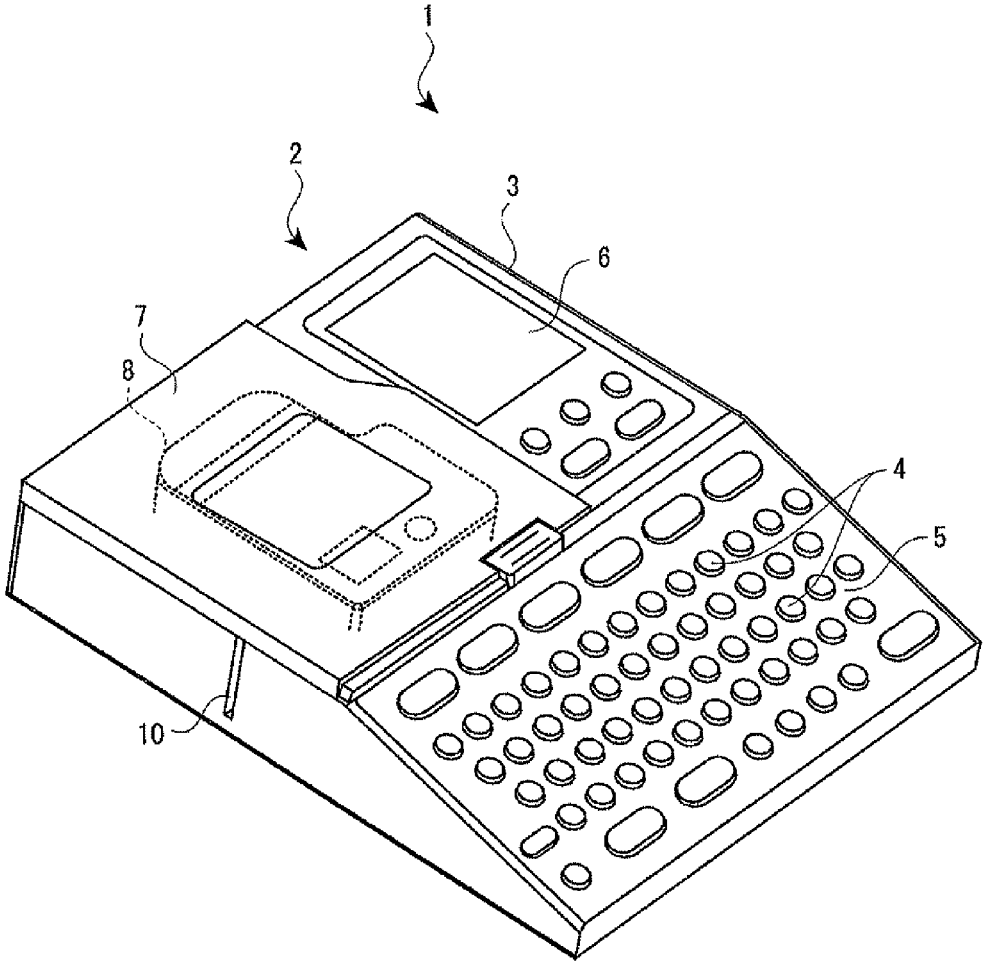
FIG. 1 is a perspective external view of a tape printer of an embodiment of the invention, in the state with the cover closed.

Referring to FIG. 1, in a tape printer 1 the outer shell of the apparatus body 2 is constituted by an apparatus case 3. At the front area of the tape printer 1 a key input section 5 equipped with various keys 4 is disposed. In the top right part of the rear half area of the tape printer 1 a liquid crystal display 6 is disposed, and over the top left surface of the rear half area of the tape printer 1 an openable cover 7 is disposed.

Figure 2:
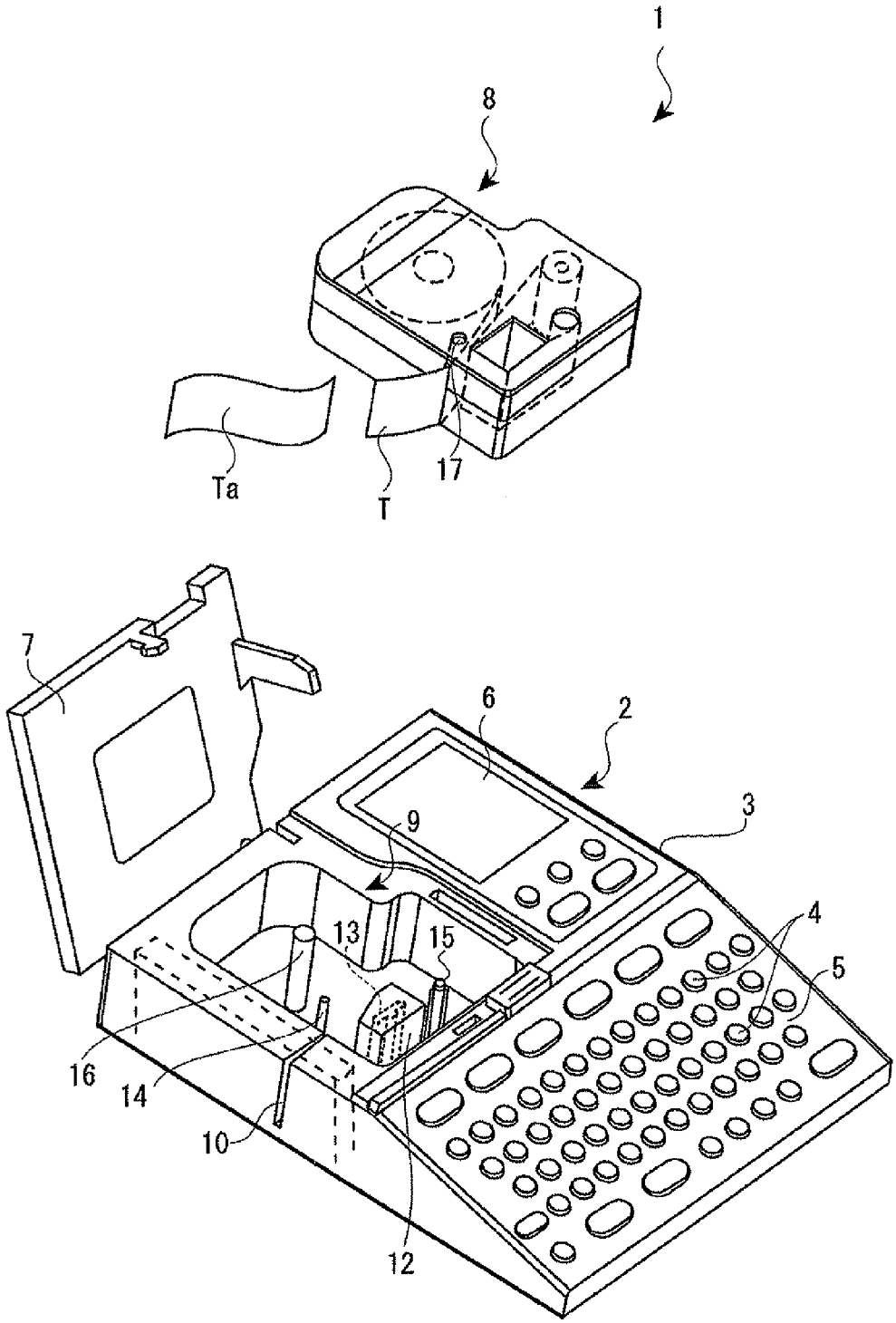
FIG. 2 is a perspective external view of the tape printer in the state with the cover opened.

Referring to FIG. 2, inside of the openable cover 7 a cartridge mounting section 9 for mounting a tape cartridge 8 is disposed. Also, on the left side portion of the apparatus case 3 a tape ejecting slot 10 that effects communication between the cartridge mounting section 9 and the apparatus exterior is formed. A tape cutter 11 (the cutter) for cutting the fed-out print tape T faces the tape ejecting slot 10.

In the cartridge mounting section 9 there are installed, standing vertically: a printing head 13 which is covered by a head cover 12; a platen shaft 14 that stands opposed thereto; a take-up spindle 15 that takes up the ink ribbon; and a guide boss 16 that guides mounting of the tape cartridge 8. A platen roller (feed roller) 17 that fits onto the platen shaft 14 is mounted on the tape cartridge 8.

The platen roller 17, platen shaft 14 and take-up spindle 15, together with related parts to be described hereafter, make up the tape feed mechanism 21. The tape cutter 11 and related parts to be described hereafter make up the tape cutting mechanism 22. Further, the tape feed mechanism 21 and the tape cutting mechanism 22 are actuated by the same drive source (motor), via a power transmission mechanism 23 and a clutch mechanism 24 that are disposed below the cartridge mounting section 9 (details will be described hereafter).

To make a label Ta with the tape printer 1, first of all the openable cover 7 is opened and the tape cartridge 8 is mounted into the cartridge mounting section 9 from above. When the tape cartridge 8 has been mounted, the openable cover 7 is closed and the tape printer 1 is put into the printing standby state. Next, data input and editing is carried out via manipulation of the key input section 5. After it is confirmed on the liquid crystal display 6 that the input is as desired, a command for printing operation is made via further manipulation of the key input section 5.

When the command for printing operation is made, print tape T and ink ribbon in the tape cartridge 8 starts running simultaneously by the tape feed mechanism 21, and the desired printing is executed by the printing head 13 onto the print tape T. As the printing operation proceeds, the ink ribbon is taken up inside of the tape cartridge 8, while the print tape T that has been printed is passed out to the apparatus exterior through the tape ejecting slot 10. When the printing is complete, feed for the trailing margin portion is executed, and running of the print tape T and ink ribbon is stopped. Then the tape cutter 11 is actuated by the tape cutting mechanism 22 and cuts the print tape T.

The power system, which has the tape feed mechanism 21 and the tape cutting mechanism 22 as its output end, will now be described in detail, referring to FIGS. 3 and 4. The power system is composed of a motor 31 which is the power source; a drive section 32 constituted of a gear train coupled to the shaft of the motor 31; a clutch mechanism (the clutch) 24 coupled to the drive section 32; a power transmission mechanism 23 constituted of a feed mechanism gear train (roller reduction gear train) 33 and a cutting mechanism gear train (cutter reduction gear train) 34 that are selectively coupled via the clutch mechanism 24; a tape feed mechanism 21 coupled to the feed mechanism gear train 33; and a tape cutting mechanism 22 coupled to the cutting mechanism gear train 34. The motor 31, power section 32, clutch mechanism 24 and power transmission mechanism 23 are installed on a base frame 25 that is disposed in the space below the cartridge mounting section 9.

The motor 31 is configured to be able to rotate in regular and reverse directions. When the motor 31 rotates in the regular direction, the rotational power is transmitted through the drive section 32 to the clutch mechanism 24, the clutch mechanism 24 automatically switches over to the feed mechanism gear train 33, and the rotational power is further transmitted to the feed mechanism gear train 33 and the tape feed mechanism 21. As a result, the platen shaft 14 and the take-up spindle 15 rotate, feeding the print tape T and ink ribbon simultaneously. On the other hand, when the motor 31 rotates in the reverse direction, the rotational power is transmitted through the drive section 32 to the clutch mechanism 24, the clutch mechanism 24 automatically switches to the cutting mechanism gear train 34, and the rotational power is further transmitted to the cutting mechanism gear train 34 and the tape cutting mechanism 22. As a result, the tape cutter 11 executes cut operation, cutting the print tape T.

The motor 31 is configured as a DC motor and is fixed to the base frame 25. The drive section 32 is composed of a worm 36 that is fixed to the shaft of the motor 31, a worm wheel 37 that meshes with the worm 36, a broad gear 38 that is coaxially fixed below the worm wheel 37, and a spindle 39 that rotatably supports the worm wheel 37 and the broad gear 38. Rotational power of the motor 31 has its direction changed by passing through the worm 36 and worm wheel 37, then is input to the clutch mechanism 24 via the broad gear 38.

Also, the worm 36 is provided with an encoder 61 that detects the rotation amount of the worm 36 to generate drive signals for synchronizing the print tape T feed operation with driving of the printing head 13. The encoder 61 is composed of a slitted disc 62 attached to one end of the axis of the worm 36, and a photointerrupter (not shown) that faces the slitted disc 62.

The slitted disc 62 rotates integrally with the worm 36, and is configured with eight evenly spaced vanes (constituted of eight cut-away portions and eight non-cut-away portions) disposed around its circumference, which intermittently block the light beam of the light-emitting element inside of the photointerrupter. The encoder 61 photoelectrically converts the blocked/passing status of the beams into pulse signals, and transmits the pulse signals to the drive control section 140 (see FIG. 9).

Figure 5:
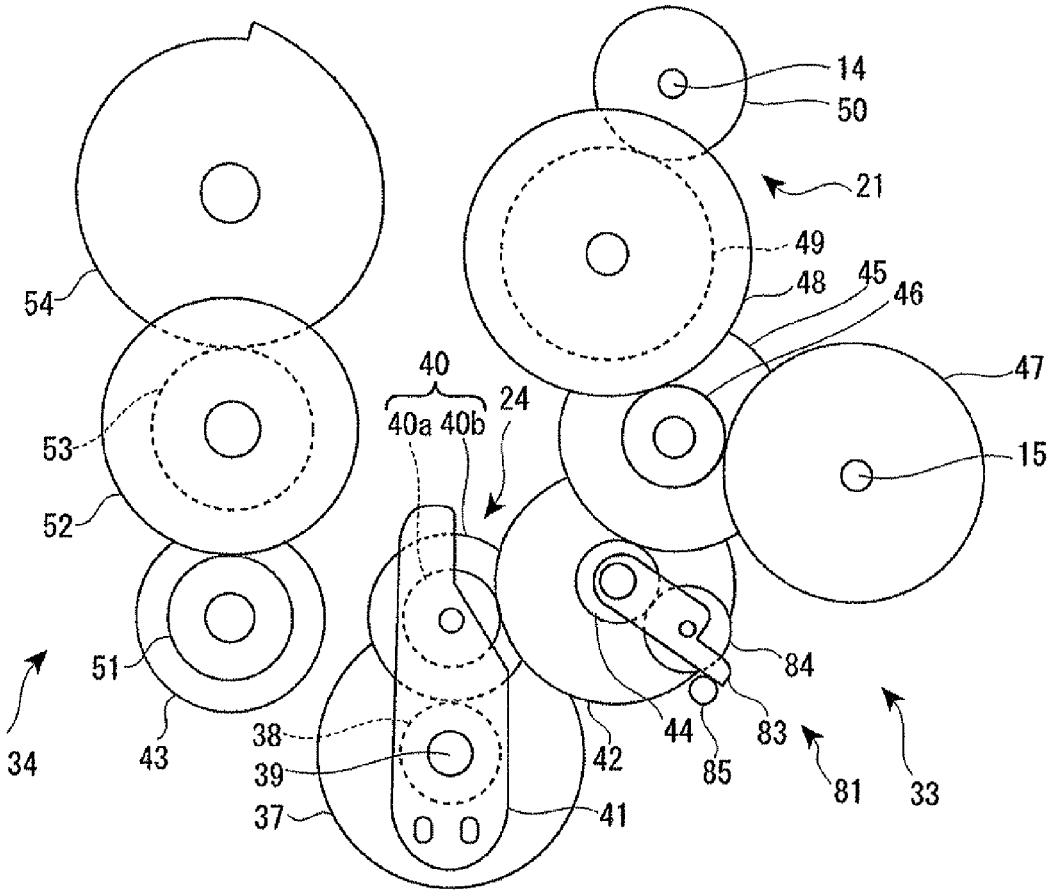
FIG. 5 is a bottom plan view of the gear train in the power system of the tape printer.
Figure 6A:
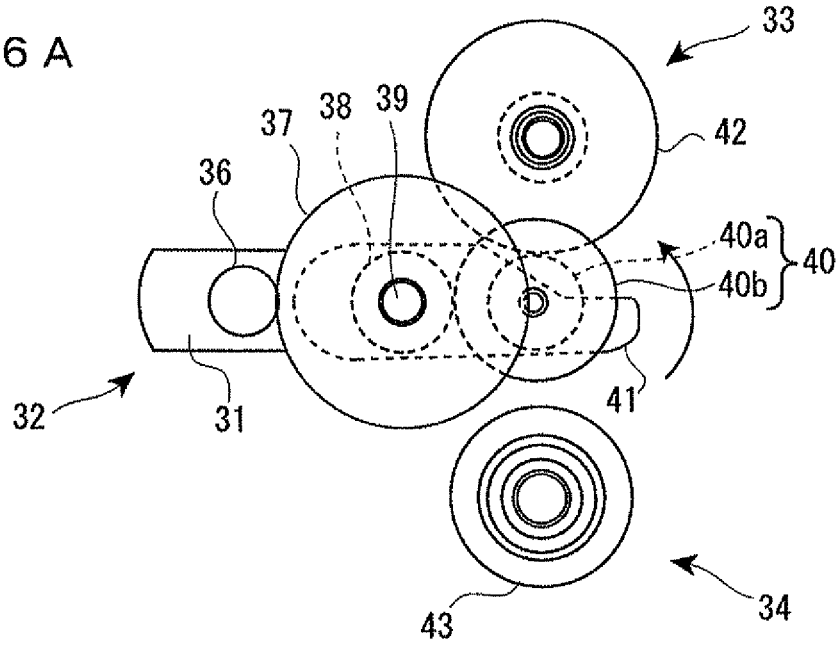
FIGS. 6A and 6B are plan views illustrating the clutch and surrounding parts in the power system of the tape printer.
Figure 6B:
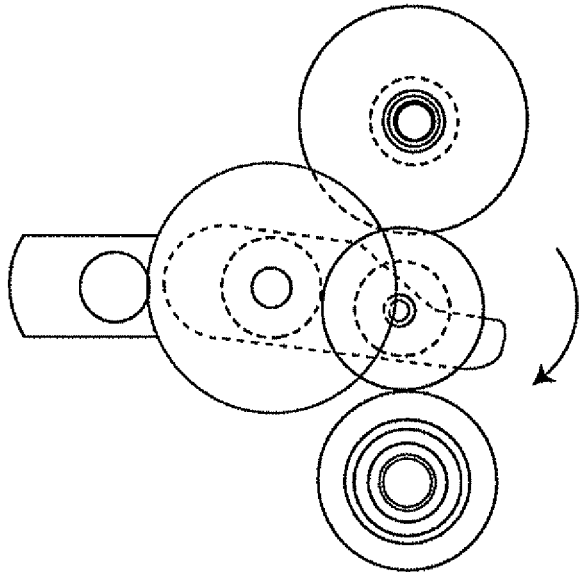

As FIGS. 5, 6A and 6B show (FIG. 5 is a vertically inverted view), the clutch mechanism 24 has a clutch section planetary gear 40 that meshes with the broad gear 38 of the drive section 32, and a clutch section carrier 41 that rotatably supports the shaft of the clutch section planetary gear 40 at the end portion and is supported by the aforementioned spindle 39 so as to be able to rotate in association therewith. The clutch section planetary gear 40 is made up of a lower clutch section planetary gear 40*a* formed with a small diameter, and a large-diameter upper clutch section planetary gear 40*b* that is coaxially fixed thereto.

When the motor 31 rotates in the regular direction and the broad gear 38 rotates, the clutch section carrier 41 turns in associated rotation due to friction with the broad gear 38, and the clutch lower planetary gear 40*a* meshes with the feed side input gear 42 of the feed mechanism gear train 33. The rotation of the broad gear 38 is transmitted to the clutch upper planetary gear 40*b* that meshes therewith, and at the moment when the clutch lower planetary gear 40*a* meshes with the feed side input gear 42, is transmitted through the clutch lower planetary gear 40*a* to the feed side input gear 42, causing the latter to rotate (see FIG. 6A). Similarly, when the motor 31 rotates in the reverse direction, the broad gear 38 rotates in the opposite direction to the aforementioned, and the clutch section carrier 41 turns in the reverse direction, causing the clutch upper planetary gear 40*b* to mesh with the cutting side input gear 43 of the cutting mechanism gear train 34. The rotation of the broad gear 38 is transmitted to the clutch upper planetary gear 40*b*, and at the moment when the clutch upper planetary gear 40*b* meshes with the cutting side input gear 43, is transmitted through the clutch upper planetary gear 40*b* to the cutting side input gear 43, causing the latter to rotate (see FIG. 6B).

Figure 3:
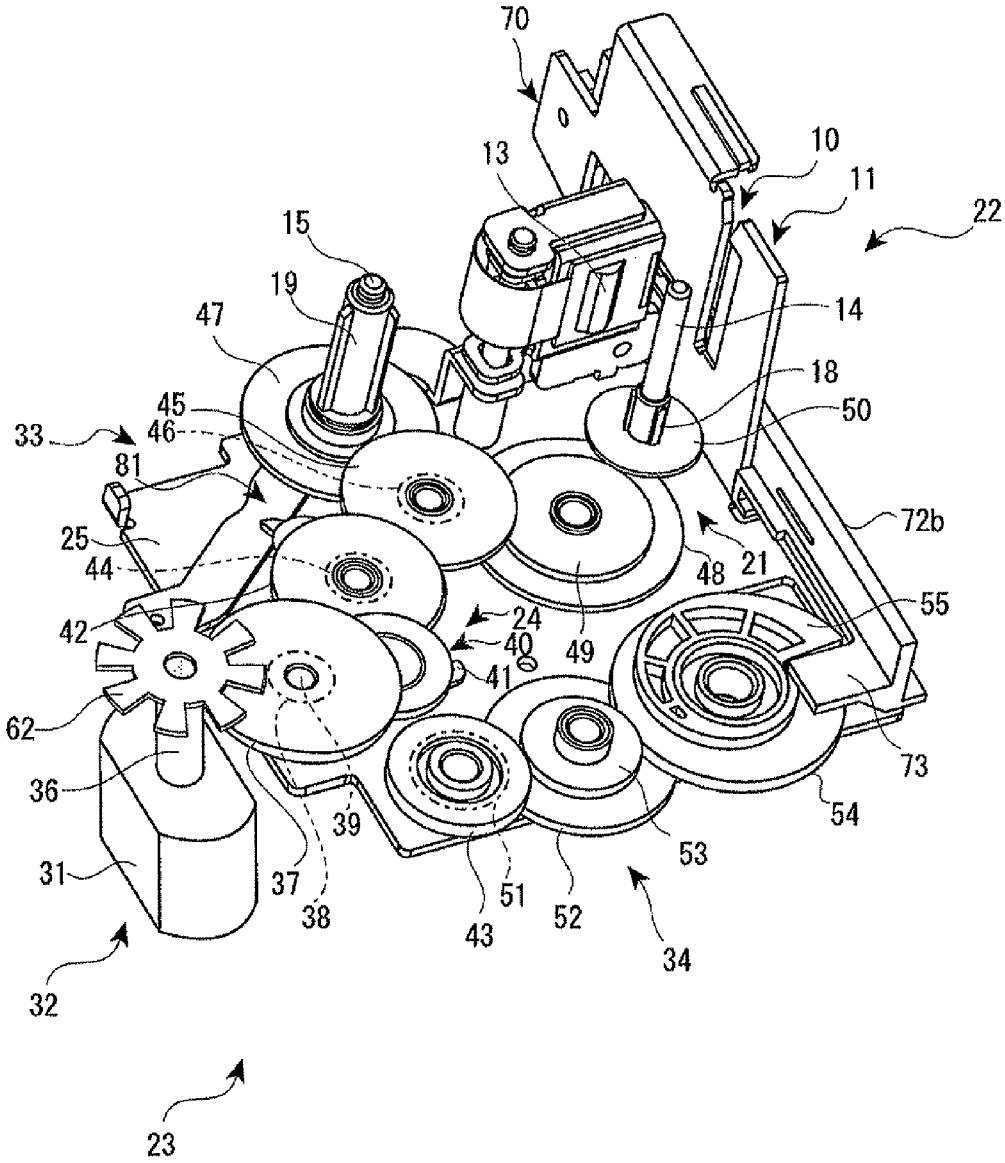
FIG. 3 is a perspective view illustrating the whole of a power system of the tape printer.
Figure 4:
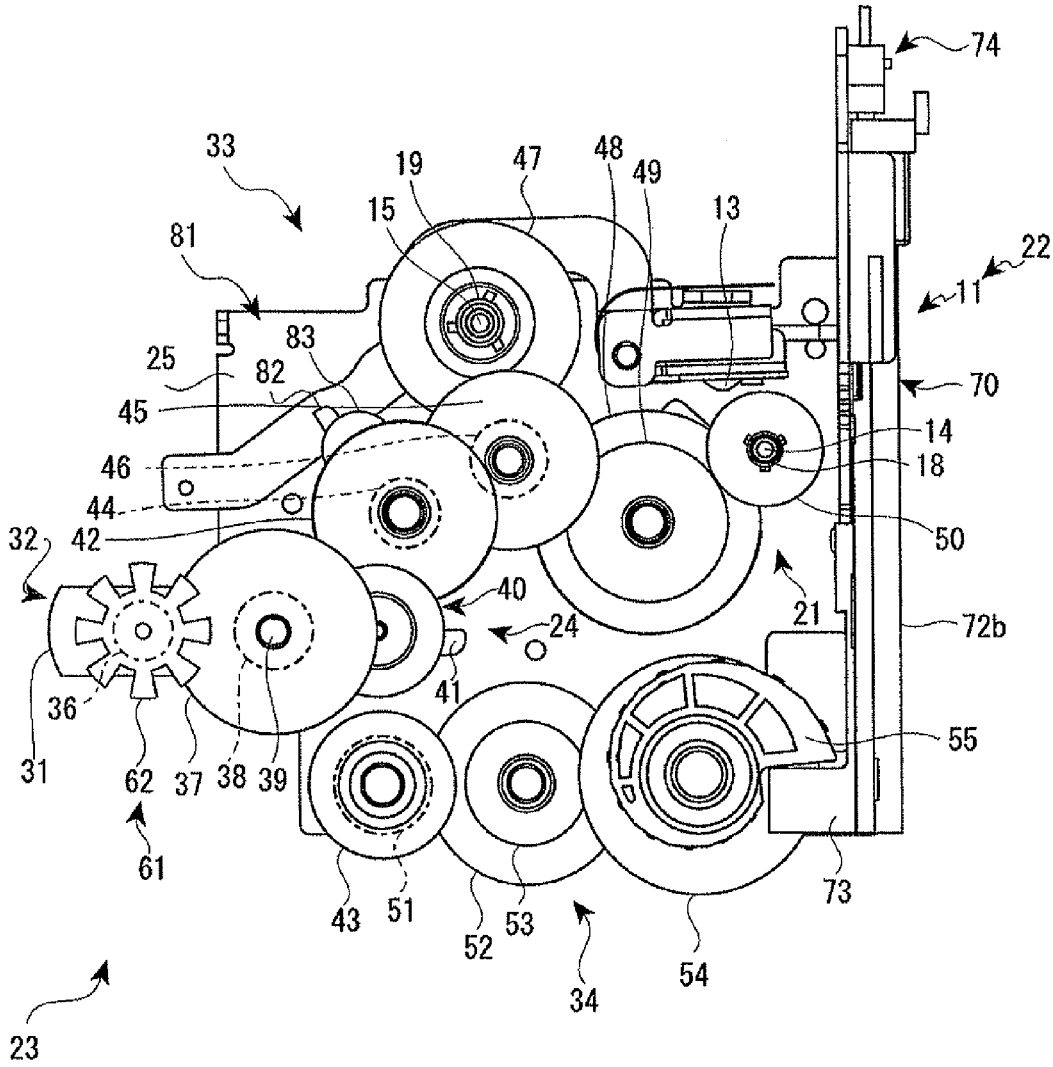
FIG. 4 is a top plan view illustrating the whole of the power system of the tape printer.

As FIGS. 3 to 5 show, the feed mechanism gear train 33 is made up of the feed side input gear 42; a first feed side intermediate gear 44 that is coaxially fixed below the feed side input gear 42; a second feed side intermediate gear 45 that meshes with the first feed side intermediate gear 44; a branching gear 46 that is coaxially fixed below the (single) second feed side intermediate gear 45; a take-up gear 47 that is located on the take-up spindle 15 and meshes with the branching gear 46; a reduction gear 48 that is located on the platen shaft 14 and also meshes with the branching gear 46; a third feed side intermediate gear 49 that is coaxially fixed above the reduction gear 48; and a platen gear 50 that meshes with the third feed side intermediate gear 49.

Rotational power that is input to the feed side input gear 42 from the motor 31 passes through the first and second feed side intermediate gears 44, 45, and then, branching at the branching gear 46, rotates the platen gear 50 via the take-up gear 47 and the third feed side intermediate gear 49. Should the user pull out the print tape T or perform some similar action that applies rotational force to the platen gear 50, the feed side input gear 42 will push away the clutch section planetary gear 40, so as to block off such force, and thereby, in such state with no load imposed from the motor 31, will also, via the branching gear 46, cause the take-up gear 47 to rotate. Thus, the pulling-out of the print tape T will result in the ink ribbon being taken up, so that slackening of the ink ribbon is prevented. Further, a reverse rotation inhibiting mechanism 81 for preventing reverse rotation of the platen roller 17 is fitted to the feed mechanism gear train 33 (details will be described hereafter).

The cutting mechanism gear train 34 is made up of the cutting side input gear 43; a first cutting side intermediate gear 51 that is coaxially fixed below the cutting side input gear 43; a second cutting side intermediate gear 52 that meshes with the first cutting side intermediate gear 51; a third cutting side intermediate gear 53 that is coaxially fixed above the second cutting side gear 52; an actuating gear 54 that meshes with the third cutting side intermediate gear 53; and an oscillating cam 55 that is fixed on one face of the actuating gear 54. Rotational power that is input to the cutting side input gear 43 from the motor 31 is transmitted, via the first, second and third cutting side intermediate gears 51, 52, 53, through the actuating gear 54 to the oscillating cam 55, causing the oscillating cam 55 to rotate.

The tape feed mechanism 21 has: a platen roller 17 that rotates in contact with the print tape T and the ink ribbon, thereby feeding them; a spline member 18 that fits into the platen roller 17; a platen shaft 14 that rotatably supports the platen roller 17 via the spline member 18; and a take-up spindle 15 that takes up the ink ribbon. The platen roller 17 is installed to the tape cartridge 8, and when the tape cartridge 8 is mounted to the cartridge mounting section 9, the platen roller 17 engages with the platen shaft 14 (the spline member 18). The platen shaft 14 is attached at one end to the base frame 25, being supported in such a manner that at the base portion, the platen gear 50 and the spline member 18 formed integrally therewith are able to rotate. Rotation of the platen shaft 14 results, via the spline member 18, in rotation of the platen roller 17.

The take-up spindle 15 is attached at one end the base frame 25, being supported in such a manner that the take-up gear 47 formed at the base portion and the coaxially mounted take-up spline member 19 are able to rotate. Rotation of the take-up gear 47 (the take-up spline member 19) results in rotation a take-up core of the ink ribbon, which engages therewith. Further, the take-up spindle 15 is a sliding spindle with a built-in coil spring, and executes appropriate sliding rotation while taking up the ink ribbon.

Figure 7:
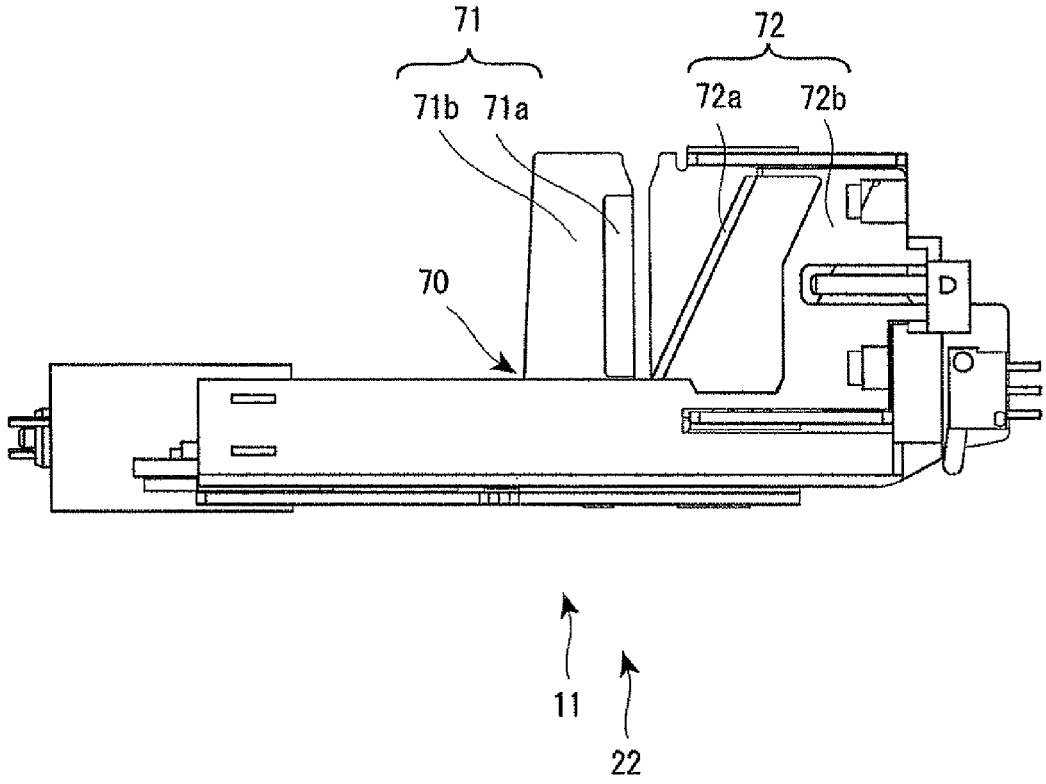
FIG. 7 is a side view illustrating a tape cutting mechanism of the tape printer.

As FIGS. 3 and 7 show, the tape cutting mechanism 22 has a tape cutter 11 that cuts the print tape T by sliding horizontally, and a cutter frame 70 that supports the tape cutter 11 and is installed to rise vertically up from an end of the base frame 25. The tape cutter 11 is made up of a fixed blade 71 constituted of a fixed edge 71*a* and a fixed edge holder 71*b* that holds the fixed edge 71*a*; and a moving blade 72 constituted of a moving edge 72*a* and a moving edge holder 72*b* that holds the moving edge 72*a*. The fixed edge holder 71*b* includes a portion for forming a tape feed slit of the cutter frame 70, and it is to this portion that the fixed edge 71*a* is installed, in such a manner as to be parallel with the print tape T. The moving edge holder 72, on the other hand, is formed in an L-shape, being disposed so as to fit along the outside of the cutter frame 70, and is slidably supported by the cutter frame 70. The moving edge 72*a*, which is configured as an oblique edge, is installed to the upper part of the moving edge holder 72*b* so as to oppose the fixed edge 71*a*. A cam follower 73 is formed integrally with the rear end portion of the movable edge holder 72*b*. This cam follower 73 engages with the oscillating cam 55, and upon receiving rotation from the oscillating cam 55, causes the moving blade 72 to execute cutting operation.

The reverse rotation inhibiting mechanism 81 that is installed to the feed mechanism gear train 33 will now be described. The reverse rotation inhibiting mechanism 81 suppresses reverse rotation of the platen roller 17 during switchover of the clutch mechanism 24. More precisely, the platen roller 17 is liable to rotate in the reverse direction (rotate in the opposite direction to the feeding direction), due to becoming elastically deformed, or due to the action of the antireverse spring for the print tape, or of some related part, when the drive of the motor 31 is stopped while the connection to the motor 31 is switched from the tape feed mechanism 21 to the tape cutting mechanism 22 by the clutch mechanism 24; and the reverse rotation inhibiting mechanism 81 inhibits such reverse rotation of the platen roller 17 (to be more specific, the reverse rotation inhibiting mechanism 81 lessens the amount of such reverse rotation).

Figure 8A:
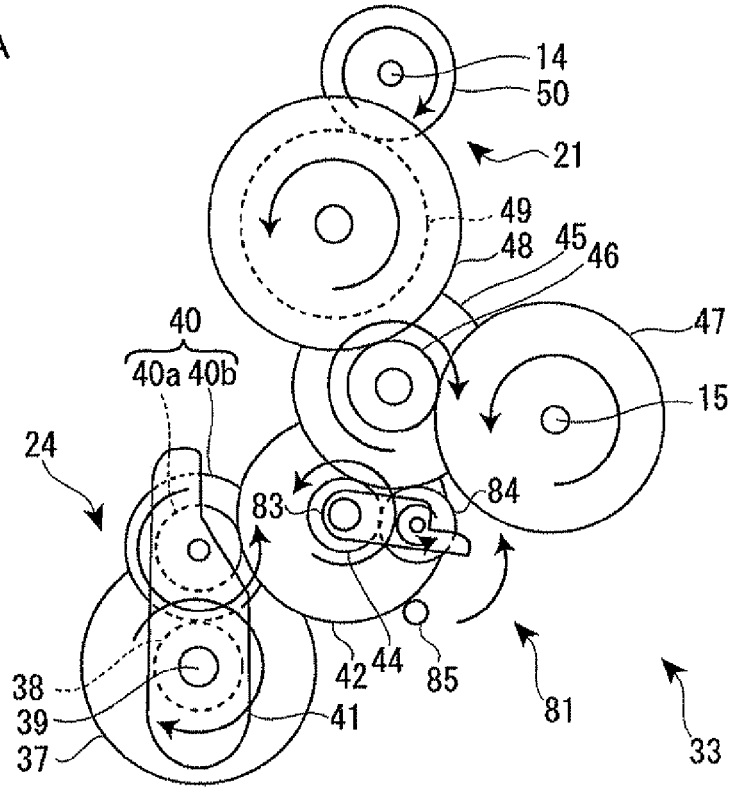
FIGS. 8A and 8B are bottom plan views of the reverse rotation inhibiting mechanism and surrounding parts in the power system of the tape printer.
Figure 8B:
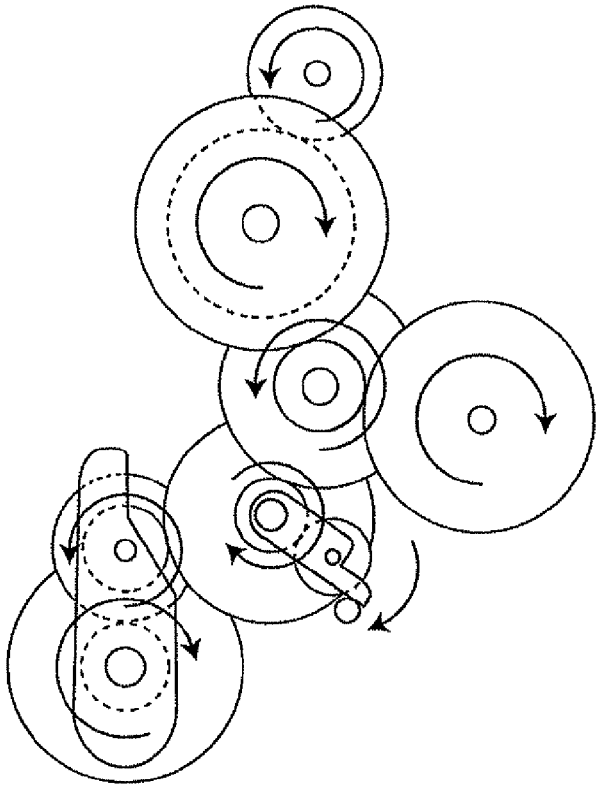

As FIGS. 3 to 5 and FIGS. 8A and 8B show (FIGS. 5, 8A and 8B are vertically inverted views), the reverse rotation inhibiting mechanism 81 includes a reverse rotation inhibiting section carrier gear 83 that is rotatably supported on the gear shaft to which the feed side input gear 42 and the first feed side intermediate gear 44 are fixed, and a reverse rotation inhibiting section planetary gear 84 that meshes with the first feed side intermediate gear 44 and is rotatably supported on the reverse rotation inhibiting section carrier gear 83.

When the platen roller 17 rotates in the reverse direction, the reverse rotation power therefrom passes through the platen gear 50, the third feed side intermediate gear 49, the reduction gear 48, the branching gear 46 and the second feed side intermediate gear 45, causing the first feed side intermediate gear 44 (feed side input gear 42) to rotate. When the first feed side intermediate gear 44 rotates, the reverse rotation inhibiting section planetary gear 84 that meshes therewith rotates in coupled motion, and also, the reverse rotation inhibiting section carrier gear 83 rotates due to friction with the first feed side intermediate gear 44, so that the reverse rotation inhibiting section planetary gear 84 meshes with the second feed side intermediate gear 45 (see FIG. 8A). As a result, the power transmitted from the platen roller 17 and the power transmitted from the reverse rotation inhibiting section planetary gear 84 offset each other on the second feed side intermediate gear 45 and the branching gear 46, stopping reverse rotation of the platen roller 17. Note that when the feed side input gear 42 (first feed side intermediate gear 44) rotates in the regular direction (rotates in the feeding direction), the reverse rotation inhibiting section carrier gear 83 turns in reverse, moves apart from the second feed side intermediate gear 45, and drives the tape feed mechanism 21 in the normal manner (see FIG. 8B). Also, in the turn orbit of the reverse rotation inhibiting section carrier gear 83, on the side away from the second feed side intermediate gear 45, there is disposed a stopper 85 for regulating the turning of the reverse rotation inhibiting section carrier gear 83, threrby the reverse rotation inhibiting section carrier gear 83 turns in between the stopper 85 and the second feed side intermediate gear 45.

Thus, because the reverse rotation inhibiting mechanism 81 is installed on the input side of the feed mechanism gear train 33 (second feed side intermediate gear 45), when the platen roller 17 rotates in the reverse direction, the rotational power therefrom is stepped up and transmitted to the reverse rotation inhibiting mechanism 81, actuating the latter. (If, for example, the reverse rotation inhibiting mechanism 81 is actuated by a 5° rotation of the object coupled thereto, and the degree of reduction from the platen roller 17 up to the branching gear 46 is 1/50, then it will be possible to stop the reverse rotation by only $5\times1/50=0.1°$ rotation of the platen roller 17.) Thereby, following performance in reverse rotation inhibition is improved, and the amount by which the feed roller rotates in reverse during reverse rotation can be lessened. As a result, reverse feeding of the print tape T can be suppressed, and print processing onto the print tape T can be executed with good precision.

Figure 9:
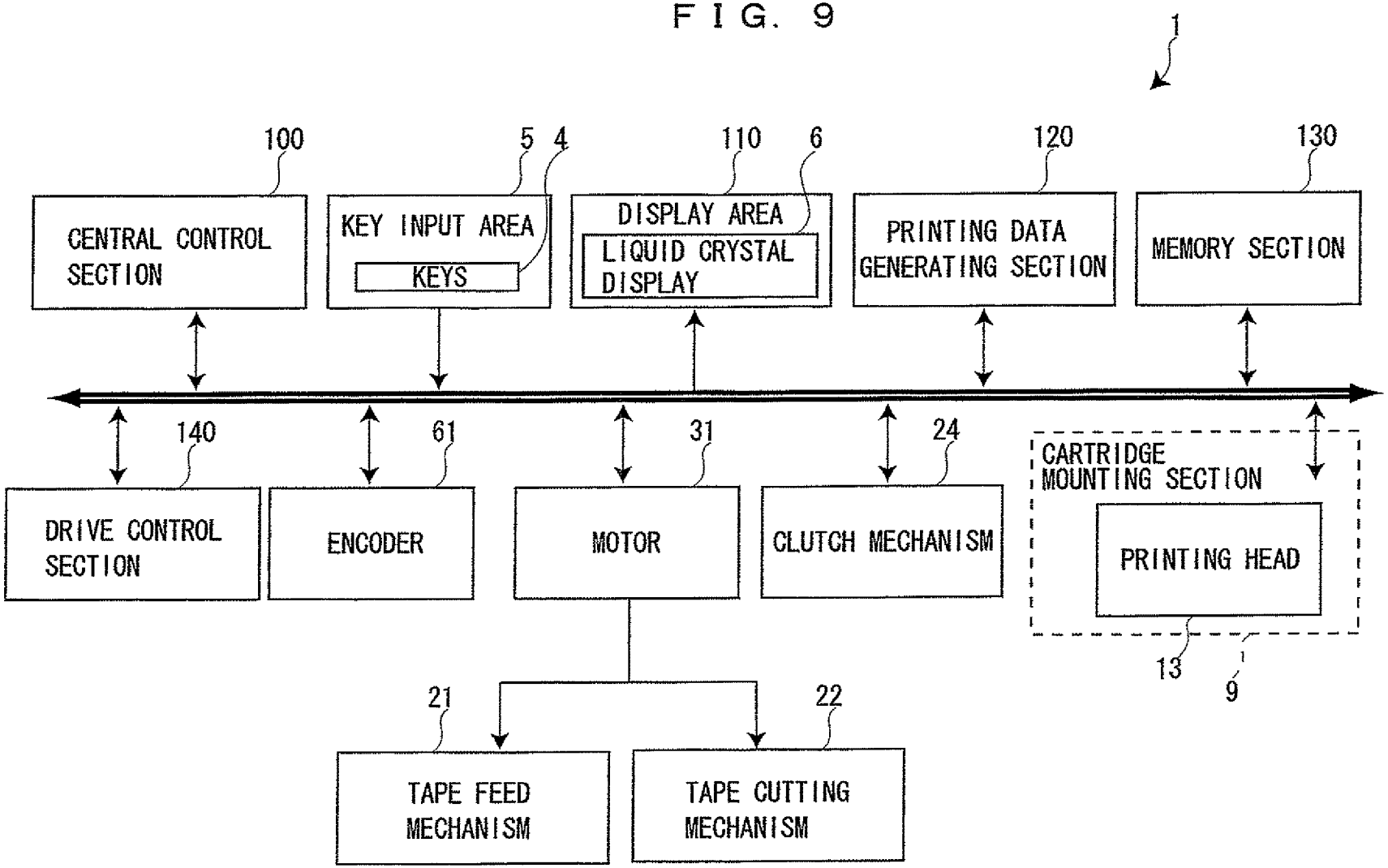
FIG. 9 is a block diagram setting forth a control system of the tape printer.

The control system of the tape printer 1 will next be described, referring to FIG. 9. As the constituents of such control system, the tape printer 1 mainly includes a central control section 100, a key input area 5, a display area 110, a printing data generating section 120, a memory section 130, a drive control section 140, an encoder 61, the motor 31, the clutch mechanism 24, and the printing head 13.

The central control section 100 is constituted of a CPU or the like, and performs overall control of the various parts. The key input area 5 has various keys 4 and is for the user to perform data input manipulations and editing manipulations. The display area 110 has a liquid crystal display 6, and displays the text data that are input, as well as printing previews. The printing data generating section 120 generates printing data for having the desired printing executed onto the print tape T based on the data input via the key input area 5. The memory section 130 is constituted of a ROM, RAM or the like, and memorizes control programs and control data for the tape printer 1. Besides font data, various setting data and the like, the data memorized also include predicted idling amounts for implementing idling wait processing. The term "idling wait processing" refers to processing that delays the drive start timing for the printing head 13 relative to the drive start timing for the motor 31, taking into account the idling loss during drive start of the motor 31 (such processing will be described in detail hereafter). As the "predicted idling amounts", values for identifying a center value and minimum value for idling loss that were measured in tests (the center and minimum values themselves, or the center value and a value equal to the center value minus the minimum value, or else a like value) are memorized.

The drive control section 140 realizes the aforementioned idling wait processing by carrying out drive control of the motor 31, clutch mechanism 24 and printing head 13. Also, the drive control section 140 acquires pulse signals (drive signals) from the encoder 61, and based on the count results thereof, executes driving and stopping of the motor 31, and in addition synchronizes the timing of feeding of the print tape T and driving of the printing head 13, so as to have the desired printing executed onto the print tape T. Also, the clutch mechanism 24, by means of switchover thereof, causes the power of the motor 31 to be transmitted to either the tape feed mechanism 21 or the tape cutting mechanism 22. The printing head 13 is provided in the cartridge mounting section 9, and executes printing in units of dot columns, by selectively driving heat-emitting elements (omitted from the drawings) that are arrayed in a single column, based on the control by the drive control section.

Next, referring to FIGS. 10A and 10B and FIG. 11 and FIGS. 12A and 12B and FIGS. 13A to 13C, the drive control by the above-described drive control section 140 from printing stop (pause) up to printing restart will be described. First of all, referring to FIGS. 10A and 10B, a specific process (stop-cut processing) requiring a printing pause will be described. With the tape printer 1 of this embodiment, at the start of printing, the leading end of the print tape T is in the tape cutter 11 position, while the printing head 13 is in a position further downstream in the feeding direction from the tape cutter 11. Because of this, if the tape printer 1 is so configured that reverse feeding of the print tape T is not carried out, then of necessity a leading margin of a size equal to the dimension separating the printing head 13 and the tape cutter 11 (head-cutter distance) will occur. Accordingly, in this embodiment, if the set leading margin is short relative to such necessarily occurring leading margin, what is termed "stop-cut" processing is implemented, whereby printing (printing feed) is halted after being started, the unneeded portion of the print tape is cut off, and then printing is restarted.

Figure 10A:
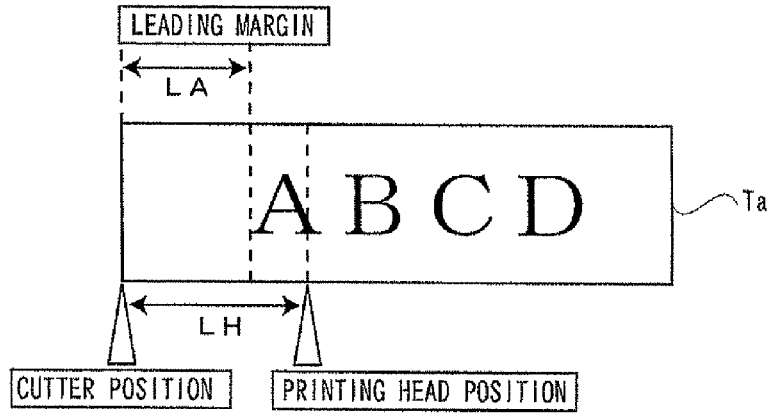
FIGS. 10A and 10B are diagrams explicating stop-cut processing.
Figure 10B:
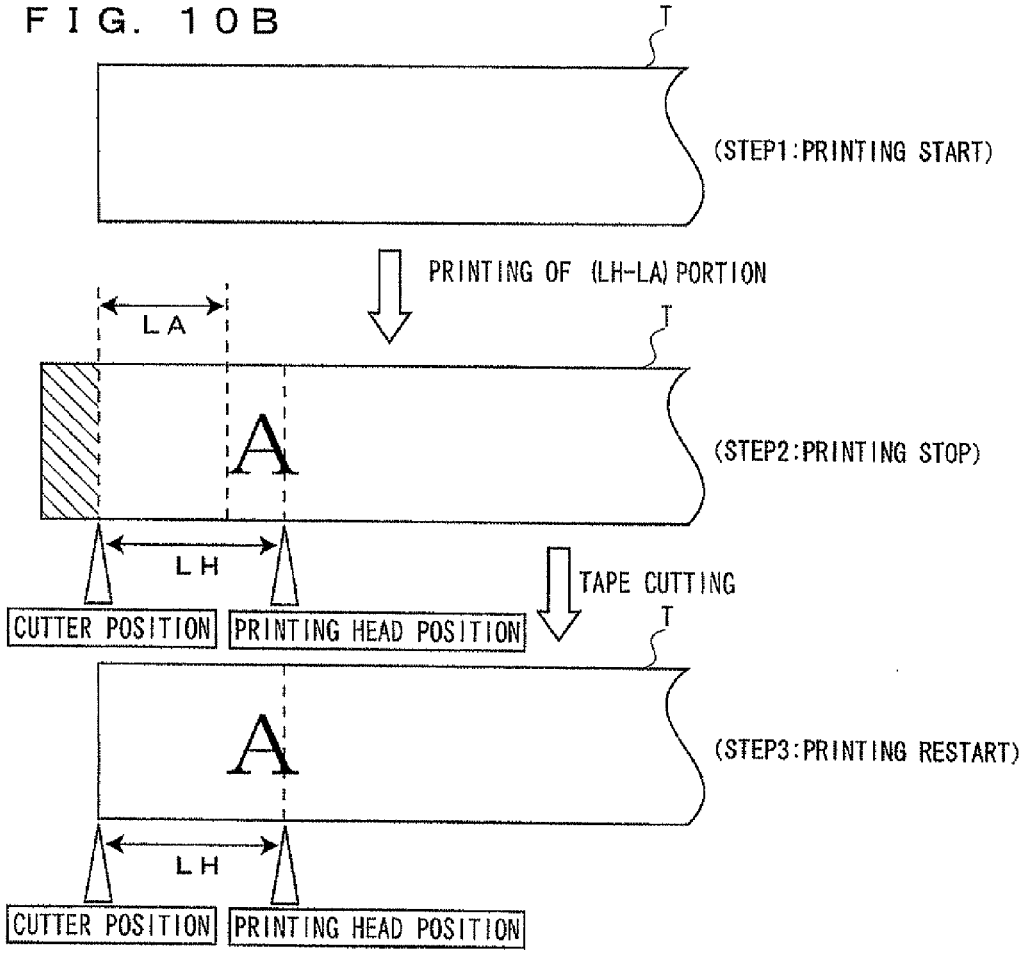

Note that, as FIG. 10A shows, "leading margin" refers to the distance (LA) from the leading edge of the label Ta, which will constitute the outcome, up to the dot column that includes the first printed dot. If this leading margin (LA) is set to be shorter than the head-cutter distance (LH), a printing pause will be necessary. The steps of the processing for such a case are shown in FIG. 10B. Initially, at the moment when printing starts, the leading end of the print tape T is in the cutter position (step 1). Starting from this state, an amount of printing equivalent to LH minus LA is executed (including the leftward feed of the tape as shown in the figure), then printing operation is halted (step 2). Following that, with the printing operation stopped, the leading end portion of the print tape T (the shaded portion in the figure) is cut off. Then printing is restarted (step 3). As shown in the example in FIG. 10B, if it is necessary to drive the heat-emitting elements at both printing stop and printing restart for the stop-cut processing (in the example in the figure, printing is stopped when the letter "A" has not been completely printed), then a gap could occur between the dot column formed prior to printing stop and the dot column printed after printing restart, and if the gap is conspicuous, the printing quality will be greatly impaired.

By contrast, the tape printer 1 of this embodiment is structured to have a clutch mechanism 24, a reverse rotation inhibiting mechanism 81, as described above. Thus, the series of operations from printing stop (step 2) up to printing restart (step 3) has different sequences. Namely, the unneeded portion of tape is cut after: stopping of the motor 31, which is driving the tape feed mechanism 21; the actuation of the reverse rotation inhibiting mechanism 81; the reverse rotation of the motor 31; the resulting switchover of the clutch mechanism 24 to the tape cutter 11; actuation of tape cutter 11; and stopping of the motor 31. Further, the printing is restarted after: the subsequently rotation of the motor 31 in the regular direction; the resulting switchover of the clutch mechanism 24 to the platen roller 17; actuation of the feed mechanism gear train 33; rotation of the platen roller 17; and deactivation of the reverse rotation inhibiting mechanism 81.

Due to the switchover of the clutch and related operations at such printing restart, the motor 31 idles from the time when the motor 31 starts regular rotation until feed of the print tape T is started. If the printing head 13 is driven in synchrony with such idling of the motor 31, printing will proceed without the print tape T being fed, which will cause faulty printing. Accordingly it is necessary to allow for such idling by delaying the drive start of the printing head 13. Thus it is necessary to determine the idling amount (idling loss amount) at such time.

Figure 11:
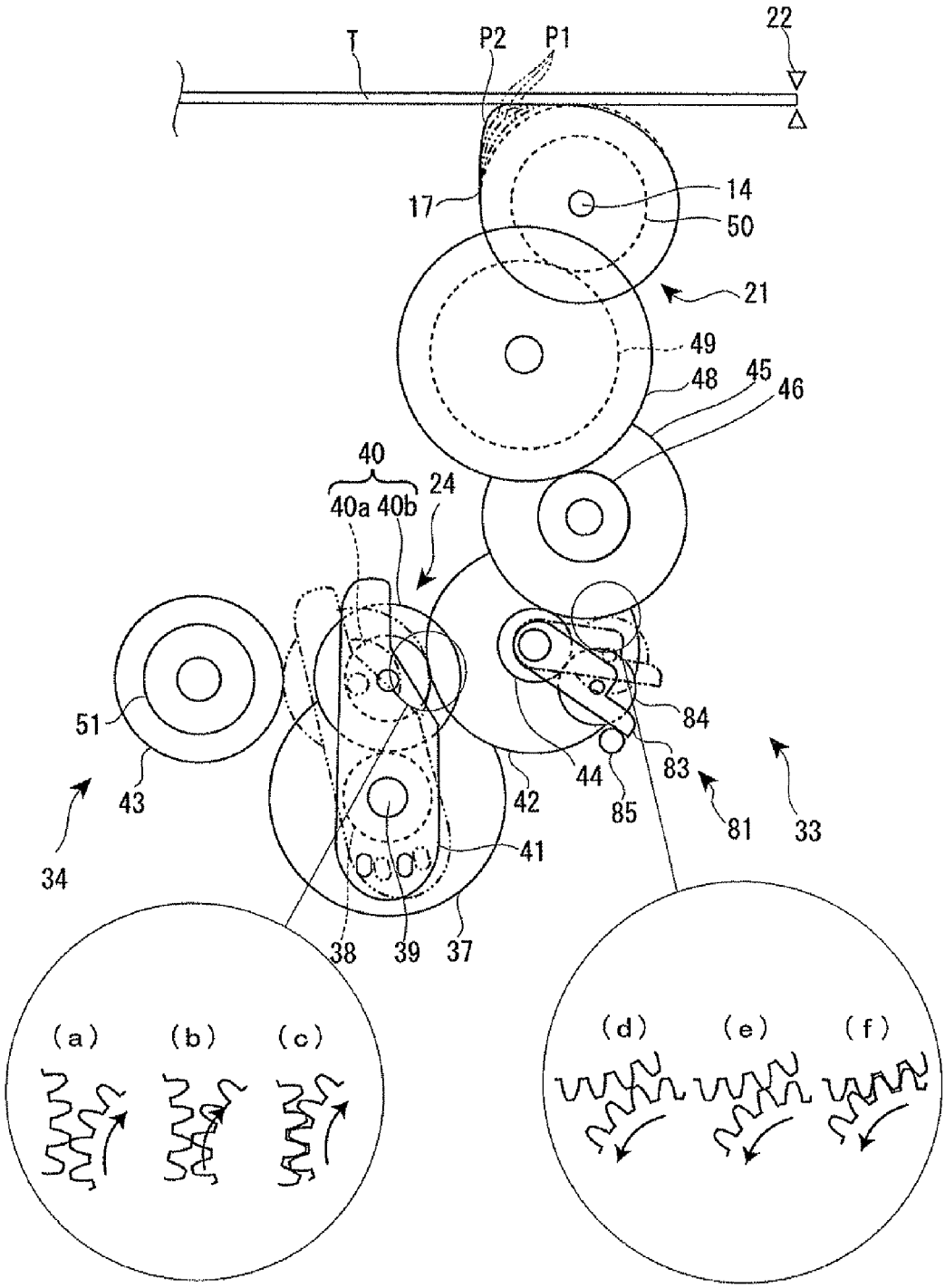
FIG. 11 is a diagram explicating the principles of occurrence of idling loss.

The principles of occurrence of idling loss will now be described, referring to FIG. 11. The causes of idling loss in the motor 31 are firstly, switchover loss in the clutch mechanism 24; secondly, gap loss due to backlash in the various gears composing the feed mechanism gear train 33; and thirdly, deformation loss due to deformation of the platen roller 17 (platen rubber).

The first cause, switchover loss in the clutch mechanism 24, is loss in order to have the gear 40 execute planetary motion between the gear 43 and the gear 42. Uncertainties are present from when teeth of the gear 40 strike teeth of the gear 42 up until their meshing therewith (see FIG. 11, (*a*) to (C)), so that strictly considered the idling amount is not constant.

The second cause, gap loss due to backlash, is a commonly known phenomenon. The contacting between the tooth surfaces of two gears becomes reversed, due to the opposition between regular rotation and reverse rotation. In the feed mechanism gear train 33, the cumulative gap losses due to backlash constitute an idling amount for the motor 31. Of course, due to errors in manufacturing and in installation, etc., strictly considered the idling amount is not constant.

The third cause, the deformation loss of the platen roller 17, is loss due to deformation (P1, P2) of the platen rubber. This loss occurs because, due to feeding resistance of the print tape T (kinetic friction and static friction), actual feeding of the print tape T starts after the platen roller has started rotating and the platen rubber has become deformed. With the printer of this embodiment, a reverse rotation inhibiting mechanism 81 is provided as described above, so that although the deformed platen rubber (P1) tries to return to its original shape when feeding of the print tape T stops, the reverse rotation inhibiting mechanism 81 is actuated part-way through such attempt, and so the platen rubber maintains the deformed state. The degree of such deformation (P1) will vary, due to the uncertainties occurring from when the teeth of the gear 84 strike the teeth of the gear 45 up until their meshing therewith (see FIG. 11, (*d*) to (*f*)). Also, when tape feed is restarted, feeding resistance of the print tape T will be static friction resistance, and feeding of the print tape T will start after the platen rubber has become deformed by a greater amount (P2) than when feeding is stopped. With the tape printer 1 of this embodiment, because the reverse rotation inhibiting mechanism 81 is provided, the deformation loss of the platen rubber can be rendered small compared to the case where no such mechanism is provided, and the degree of variation in such loss can also be rendered small. Nevertheless, the resulting idling loss cannot be ignored. Also, the degree of deformation of the platen rubber will vary with individual differences in the tape cartridges 8, with the ambient temperature, and with the pressure applied, etc. Hence, in this case too, strictly considered the idling amount is not constant.

Thus, the motor 31 idles from the start of rotation thereof up until the print tape T is fed, but the idling amount includes uncertainties and therefore is not constant. Accordingly, measurements of the idling amount are made, and based on the measurement results, timing control is implemented that delays drive start of the printing head 13 relative to drive start of the motor 31. Below, the processing that delays the drive start timing for the printing head 13 relative to the drive start timing for the motor 31 (idling wait processing) will be described in detail, referring to FIGS. 12A, 12B and 13A to 13C.

FIGS. 12A and 12B set forth an estimated value and a calculation formula for deriving the idling amount (predicted idling amount) required for idling wait processing. As can be seen from FIG. 12A, the estimated value assumes that the number of encoder vanes per dot is four out of the total of eight encoder vanes (salients on the slitted disc 62). Therefore one dot will be formed by feeding four pulses. Also, it is assumed that the stopping inertia amount of the motor 31

(amount that the motor 31 rotates until stopping completely, after the power supply stops) is N pulses (N being <4) and that the mechanical loss amount is 8±4 pulses. This mechanical loss amount includes the idling loss amounts described earlier (idling amounts due to switchover loss in the clutch mechanism 24, to gap loss resulting from backlash in the various gears composing the feed mechanism gear train 33, and to deformation loss resulting from deformation of the platen roller 17). In other words, the ±4 pulse variation of the mechanical loss arises from the variations in those idling loss amounts described earlier. This variation amount is a value obtained from the results of measurements of the idling amount made in tests.

As can be seen from FIG. 12B, the predicted idling amount, that is, the idling amount that is predicted to occur when drive of the motor 31 is restarted, is theoretically the sum of the motor stopping inertia amount correction value plus the mechanical loss amount. As used here, the term "motor stopping inertia amount correction value" refers to the value obtained by subtracting the motor stopping inertia amount (N pulses) from the number of pulses per dot (four pulses). More precisely, applying the estimated value in FIG. 12A, the predicted idling amount is (4−N)+(8±4) pulses, the maximum value being (16−N) pulses, the center value (12−N) pulses, and the minimum value (8−N) pulses.

Thus, theoretically it is possible to calculate the predicted idling amount, but if, for example, the drive start timing for the printing head 13 is delayed relative to the drive start timing for the motor 31 by an amount equal to the center value for the predicted idling amount, and the idling amount that is actually required is smaller than that center value (see related art case in FIG. 14B), then a printing gap will occur. Accordingly, with the idling wait processing of this embodiment, when printing operation is halted and restarted, the motor 31 is made to rotate just by an idling amount (first idling amount) based on the minimum value for the predicted idling amount (minimum value among the measurement results), and printing based on the data for the first dot column to be printed at printing restart is executed (such printing is termed "dummy printing" below). Then the motor 31 is made to rotate further just by an amount obtained by subtracting an idling amount based on the minimum value for the predicted idling amount from an idling amount based on the center value for the predicted idling amount, after which the printing is restarted from the data for the first dot column to be printed at printing restart.

Figure 13A:
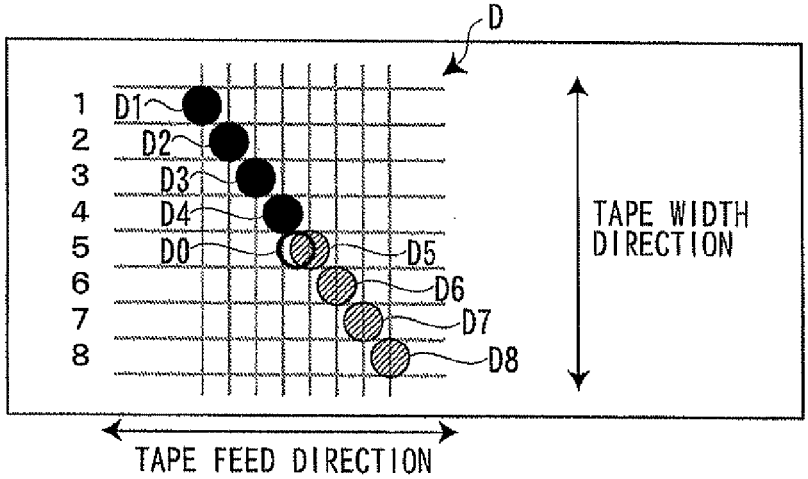
FIGS. 13A to 13C are diagrams illustrating printing results when the idling wait processing of the embodiment is implemented.
Figure 13B:
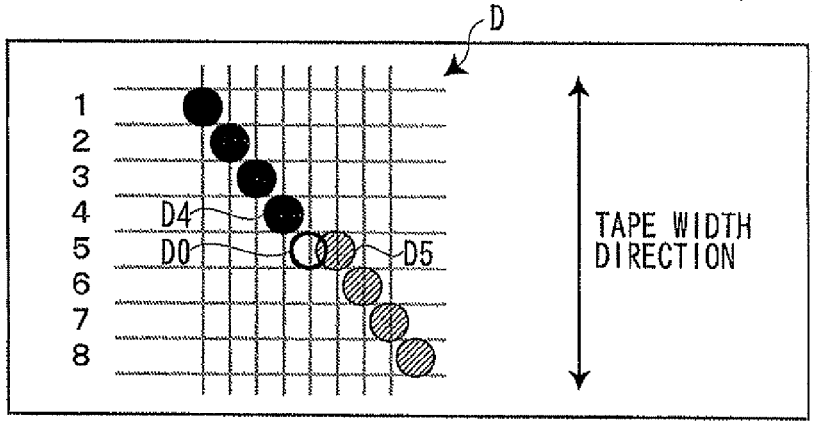
Figure 13C:
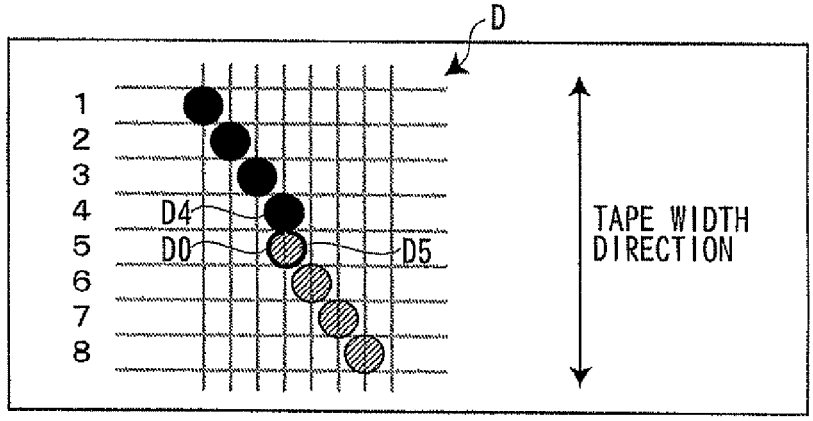
Figure 14A:
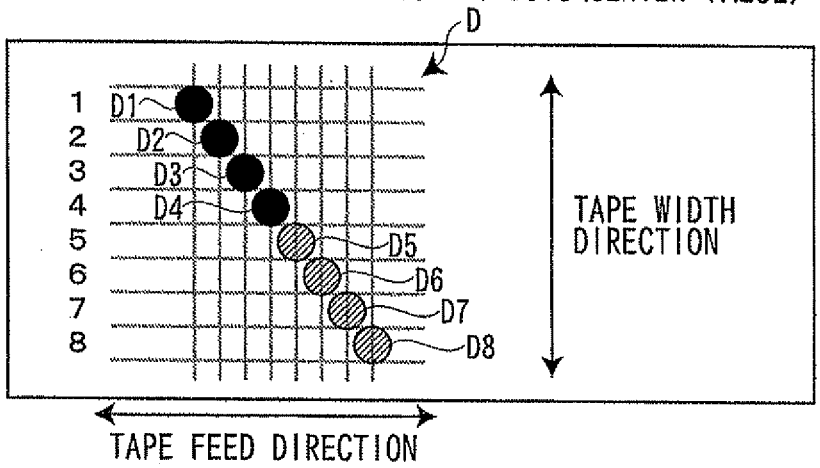
FIGS. 14A to 14C are diagrams illustrating printing results when the idling wait processing of related art is implemented.
Figure 14B:
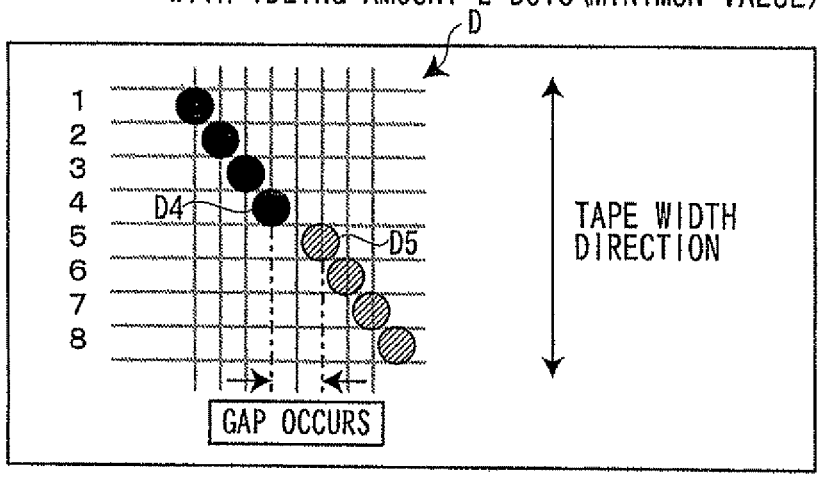
Figure 14C:
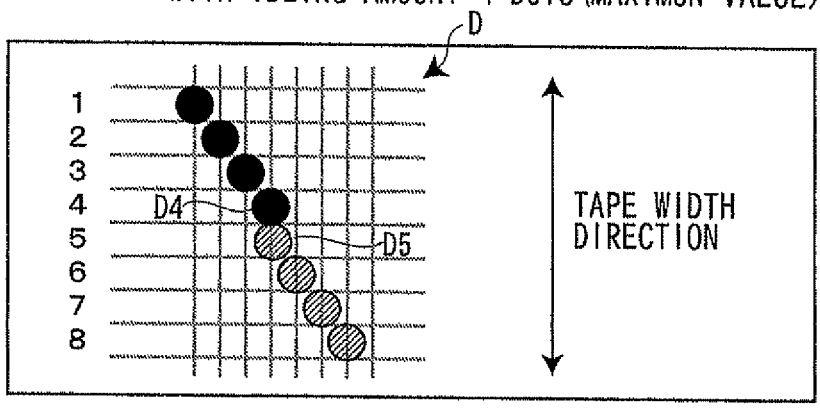

FIGS. 13A to 13C are diagrams illustrating printing results D when the idling wait processing of the embodiment is implemented. A feature of such processing, as opposed to the related art case shown in FIGS. 14A to 14C, is the addition of dummy printing of a dot D0 before printing restart (before printing of dot D5). For ease of understanding, it is assumed in the figure that the motor stopping inertia amount is zero pulses (N=0), so that the center value for the predicted idling amount is taken to be 12 pulses (=three dots), the minimum value to be eight pulses (=two dots), and the maximum value to be 16 pulses (=four dots), the variation in the idling amount being taken to be ±four pulses (=±one dot). Also, in the same way as for related art case in FIGS. 14A to 14C, the leftward direction represents the print tape feed direction, the top-and-bottom-direction the widthwise direction of the print tape T, and the columnar direction lines the width of the dot columns (units of one dot). The numerals and row-direction lines in FIGS. 13A to 13C indicate the arrangement of the heat-emitting elements. The four dots D1 to D4, which correspond to the first to fourth dots, are the dots printed before printing stops, and the four dots D5 to D8, which correspond to the fifth to eighth dots, are the dots printed after printing restarts.

As FIG. 13A shows, if the idling amount actually required is three dots (equivalent to the center value for the predicted idling amount), idling is allowed for just an amount equal to the minimum value (two dots) for the predicted idling amount, after which printing based on data for the first dot column to be printed at printing restart is executed (dummy printing, dot D0). At this point, since the motor 31 is idling and tape feed is not being implemented in the normal manner, the printing position of the dot D0 in the tape feed direction is a little mispositioned relative to the dot D4 (mispositioned by an amount less than one dot). Then, after further driving of the motor 31, onward from the dummy printing (dot D0) position, by an amount equal to the predicted idling amount center value minus the minimum value (subtraction amount: one dot) i.e., after the motor 31 has been rotated by just the center value amount, starting from the motor drive start time-point, printing (D5) based on data for the first dot column to be printed at printing restart is executed. Thereafter (D6 onward), printing continues at one dot for every four pulses. Thus, when the idling processing of this embodiment is implemented in the case where the idling amount actually required is equivalent to the center value for the predicted idling amount, printing blur occurs with dots D0 and D5 at printing of the fifth dot, but since printing blur is less conspicuous than a printing gap, even when their sizes are the same, this is unlikely to result in an appearance problem.

On the other hand, as FIG. 13B shows, when the idling wait processing of this embodiment is implemented in the case where the idling amount actually required is two dots (equivalent to the minimum value for the predicted idling amount), dummy printing (dot D0) is implemented after idling has been executed by an amount equal to just two dots, starting from the motor drive start time-point. Since the motor 31 is not idling at this time, dots D0 and D4 are mispositioned by a dot. Printing is restarted at the fifth dot (D5) after the motor has been idled for a further one-dot amount from the dummy printing (dot D0) position. Thus, due to the dummy printing (dot D0), the gap that occurs between the fourth dot (D4) and fifth dot (D5) dot columns with the idling wait processing of related art (see FIG. 14 B) can be filled in. In the example in FIG. 13B, there is no mechanical loss during the dummy printing (dot D0), and consequently dots D0 and D5 are mispositioned by 1 dot. By contrast, in the example in FIG. 13A, mechanical loss is not completely absent during the dummy printing (dot D0), and consequently dots D0 and D5 are mispositioned by less than a dot.

On the other hand, as FIG. 13C shows, when the idling wait processing of this embodiment is implemented in the case where the idling amount actually required is four dots (equivalent to the maximum value for the predicted idling amount), dummy printing (dot D0) is implemented after idling has been executed by an amount equal to just two dots. Since the motor 31 is idling at this time, the printing position of dot D0 is almost the same as the position of dot D4. Printing is restarted at the fifth dot (D5) after the motor has been idled for a further one-dot amount from the dummy printing (dot D0) position, but dots D0 and D5 are almost completely superposed. This is because the mechanical loss amount (the idling amount actually required) is large, so that the amount of decrease in the mechanical loss amount during the dummy printing (dot D0) is smaller than in the case in FIG. 13A. Note that with the idling wait processing of this embodiment, printing blur of dots D0 and D5 will occur in the present case also, but since no printing gap will occur even in the case where the idling amount actually required is equivalent to the minimum value for the predicted idling amount (the case in FIG. 13B), considered overall the quality (appearance) of the printing outcomes is improved.

As has been described above, with this embodiment, when printing operation is halted and restarted, the motor 31 is driven by an amount equal to the minimum value for the predicted idling amount (the idling amount which is predicted to occur at drive start of the motor 31) and dummy printing is implemented; and, occurrence of a gap between the dot columns (between the dot column printed before printing stop and the dot column printed after printing restart) can be suppressed. Also, since the dummy printing is based on data for the first dot column to be printed at printing restart, the dummy-printed dot column is harmonized with the dot column printed before printing stop and the dot column printed after printing restart, so that there is no impairment of the printing quality due to the dummy printing. Also, since the dummy printing is based on the minimum value for the predicted idling amount, printing gaps can be effectively rendered inconspicuous, in comparison to the case where dummy printing is implemented using a value between the minimum and center values for the predicted idling amount.

Although in this embodiment the invention is applied to a tape printer 1 that executes printing onto print tape T, the invention could of course also be applied to any printer (printing device) that feeds the print medium in synchrony with driving of the printing head 13.

Also, although this embodiment uses the example of a tape printer 1 that has a clutch mechanism 24 and a reverse rotation inhibiting mechanism 81, the invention could also be applied to printers in which those items are not present. Further, although the idling wait processing described in this embodiment accompanies stop-cut processing, it will be preferable that such idling wait processing be implemented also for printing pauses that do not involve cutting processing (cases where printing stop manipulation is carried out by the user, and like cases). That is, the invention can also be applied to printers that do not have a cutting mechanism.

Also, although with this embodiment the dummy printing is executed after the motor 31 has been driven by an amount equal to the minimum value for the predicted idling amount (the idling amount predicted to occur at drive start of the motor 31) the dummy printing might alternatively be executed after the motor 31 has been driven by an amount equal to a value greater than the minimum value and less than the center value for the predicted idling amount, rather than by an amount equal to the minimum value for the predicted idling amount. Also, although with this embodiment, after the dummy printing is executed the motor 31 is driven by a subtraction amount equivalent to the center value minus the minimum value for the predicted idling amount prior to restart of printing, it will alternatively be possible to halve the subtraction amount value and restart printing after a second dummy printing is executed (each dummy printing being equivalent to one half of the subtraction amount value), and after idling of the same amount (one half of the subtraction amount value). In other words, multiple dummy printings might be executed.

Also, even with the number of dummy printings kept to a single dummy printing, it will be possible to use a smaller motor drive amount (predicted idling amount) for the time from drive start of the motor 31 up until when printing is restarted. In other words, it will be possible to use a smaller idling amount (subtraction amount) for the time from dummy printing up to printing restart. With such a configuration, printing blur will be increased, but printing gaps will be rendered more inconspicuous. Also, for the motor drive amount from printing stop up until printing restart, the mean value of the idling amount measurement results might be used, instead of the center value for the predicted idling amount.

Also, the various constituents of the tape printer 1 of this embodiment can be provided in the form of a computer program. Such program can be provided stored in a recording medium of various kinds (CD-ROM, flash memory or the like). More precisely, a computer program that enables a computer to function as the various means of the tape printer 1, and a recording medium in which such program is recorded, is to be included within the scope of the invention rights. Furthermore, other variants of the invention may be made as appropriate without departing from the spirit and scope of the invention.

What is claimed is:

1. A printer, comprising:

a printing head configured to execute printing in units of columns of dots;

a feed roller configured to feed a print medium;

a motor configured to drive the feed roller;

a drive control section configured to control driving of the printing head and the motor; and a memory section that memorizes a predicted idling amount of the motor, the predicted idling amount being a predicted amount which the motor rotates by the time when the feed roller has fed the print medium to a position where a next column of dots are to be printed after drive of the motor starts, wherein in case of halting and restarting printing operation, the drive control section implements printing of data for a first dot column to be printed at printing restart after driving the motor by a first driving amount, further restarts printing from the first dot column data after driving the motor by a second driving amount, and a sum of the first driving amount and the second driving amount corresponds to the idling amount.

2. The printer according to claim 1, wherein the memory section memorizes as the first driving amount a smallest value of results of measurements of the idling amount made in a test.

3. The printer according to claim 1, wherein the memory section memorizes as the predicted idling amount a center value or a mean value of results of measurements of the idling amount made in a test.

4. The printer according to claim 1, further comprising:

a printing data generating section configured to generate printing data; and a cutter configured to cut the print medium so that a printed portion has a length based on the printing data in accordance with control of the drive control section, wherein when a leading margin LA dimension, equivalent to a distance from a leading edge of the print medium to a printing start position, is less than a distance LH between the printing head and the cutter, the drive control section halts printing operation when a portion equivalent to LH minus LA has been printed, and restarts printing operation after the cutter has cut the print medium.

5. The printer according to claim 4, further comprising:

a roller reduction gear train configured to transmit power of the motor to the feed roller;

a cutter reduction gear train configured to transmit the power of the motor to the cutter; and a clutch configured to transmit regular rotational power of the motor to either the roller reduction gear train or the cutter reduction gear train, and transmit reverse rotational power of the motor to the other of the two.

6. The printer according to claim 5, further comprising a reverse rotation inhibiting mechanism configured to be installed on an input side of the roller reduction gear train and inhibit reverse rotation of the feed roller, wherein when reverse rotational power of the feed roller is back-input into the roller reduction gear train, the reverse rotation inhibiting mechanism is actuated and inhibits reverse rotation of a single gear disposed on the input side of the roller reduction gear train.

7. A control method for a printer including a printing head that performs printing in units of columns of dots, a feed roller that feeds a print medium, a motor that drives the feed roller, a drive control section that controls driving of the printing head and the motor, and a memory section that memorizes a predicted idling amount of the motor, the predicted idling amount being a predicted amount which the motor rotates by the time when the feed roller has fed the print medium to a position where a next column of dots are to be printed after drive of the motor starts, the control method comprising:

(a) implementing printing of data for a first dot column to be printed at printing restart after driving the motor by a first driving amount, and (b) after step (a), restarting printing from the first dot column data after driving the motor by a second driving amount, wherein a sum of the first driving amount and the second driving amount corresponds to the idling amount.

8. A non-transitory computer-readable medium comprising a computer program that enables a computer to execute each process of the control method according to claim 7.

* * * * *